United States Patent [19]

Fabrig

[11] 4,403,896

[45] Sep. 13, 1983

[54] APPARATUS FOR CONVERTING HOLES IN A STACK OF OVERLAPPING LEAVES INTO ARCUATE PASSAGES

[75] Inventor: Paul Fabrig, Neuffen, Fed. Rep. of Germany

[73] Assignee: Womako Maschinenkonstrucktionen GmbH, Nürtingen, Fed. Rep. of Germany

[21] Appl. No.: 160,440

[22] Filed: Jun. 17, 1980

[30] Foreign Application Priority Data

Dec. 22, 1979 [DE] Fed. Rep. of Germany ..... 2952183

[51] Int. Cl.[3] ..... B42B 5/08

[52] U.S. Cl. ..... 412/38; 270/53

[58] Field of Search ..... 270/53; 11/1 R, 1 A; 412/7, 39, 42, 38; 140/92.4, 92.7

[56] References Cited

U.S. PATENT DOCUMENTS 4,157,821 6/1979 Fabrig ..... 270/53

4,161,196 7/1979 Fabrig ..... 11/1 R

*Primary Examiner*—Paul A. Bell

*Assistant Examiner*—John S. Brown

*Attorney, Agent, or Firm*—Kontler, Grimes & Battersby

[57] ABSTRACT

Apparatus for converting straight or inclined holes along one edge face of a stack of leaves into arcuate passages for convenient threading of the leader of a spiral wire binder has a locating device which holds the stack in a given position. Two rows of pivotable and retractible straight mandrels are adjacent to opposite sides of the stack in the locating means, and such mandrels are introduced into the registering holes of the stack prior to movement of the convex surface of a shaping member against the edge face of the stack. The convex surface shifts the leaves of the stack relative to each other and causes the leaves to pivot the mandrels to mutually inclined positions. At the same time, the leaves convert the holes into arcuate passages whose curvature conforms to that of the convex surface on the shaping member. The stack is thereupon clamped during withdrawal of mandrels from the arcuate passages.

28 Claims, 5 Drawing Figures

APPARATUS FOR CONVERTING HOLES IN A STACK OF OVERLAPPING LEAVES INTO ARCUATE PASSAGES

BACKGROUND OF THE INVENTION

The present invention relates to apparatus for manipulating stacks of sheets or leaves (hereinafter called leaves) which consist of paper, metallic foil, cardboard, plastic foil or the like. More particularly, the invention relates to improvements in apparatus for manipulation of stacks which consist of perforated leaves and wherein the perforations of neighboring leaves at least partially overlap each other to form holes which extend from the one to the other side of the stack. Still more particularly, the invention relates to improvements in apparatus for manipulating stacks of overlapping leaves for the purpose of converting originally straight or inclined holes in one marginal portion of the stack into arcuate passages for convenient introduction of binders, such as spiral binders of the type customarily found in many types of steno pads, exercise books or like stationery products.

It is already known to change the configuration of holes in one marginal portion of each of a series of stacked leaves in order to facilitate the introduction of binders, either in the form of spirals or in the form of C-shaped prongs which are thereupon converted into rings. In many instances, the conversion of straight holes into arcuate passages whose curvature and/or lead resembles the curvature and/or lead of portions of binders is effected by resorting to mandrels which are introduced into the holes and are thereupon pivoted to change the configuration of the holes. It is also known to resort to a shaping member and to means for urging the shaping member against that end face of the stack which is nearest to the row of holes in order to change the shape of the end face by shifting the leaves of the stack relative to each other and by thus changing the configuration of previously straight holes. Reference may be had, for example, to German Pat. No. 1,817,815 which discloses an apparatus with two rows of mandrels. Each mandrel is of arcuate shape and its curvature matches that of the convolutions of a spiral binder. Moreover, the mandrels are inclined in such a way that their inclination matches or approximates the lead of convolutions forming part of a spiral binder which is to be introduced into the deformed holes or passages of the stack. The apparatus comprises means for effecting coarse conformance of originally straight holes to the curvature and lead of convolutions of a spiral binder; this is achieved by resorting to suitable shaping and guide members. In the next step, the arcuate mandrels are caused to penetrate into the partially deformed holes, and the adjacent edge face of the stack is deformed by the shaping member which causes the leaves to move relative to each other so as to achieve a more accurate conformance of the holes or passages to the curvature and lead to the mandrels.

The shifting of leaves for the purpose of conforming the configuration of holes or passages to the lead of convolutions which form part of a spiral binder is relatively simple and can be readily achieved during transport of a stack and/or by resorting to appropriate orienting means at the station where the stacks are assembled. However, conversion of the thus partially deformed or oriented holes into passages whose curvature matches that of a convolution in a spiral binder presents greater problems and takes up more time. The problems are especially acute if the stack is relatively thick, i.e., if the stack comprises a large number of leaves and/or if some or all of the leaves are rather thick. The aforementioned German Pat. No. 1,817,185 purposes to effect preliminary or coarse changes in the configuration of holes to approximate the curvature of the convolutions by resorting to a shaping member which applies sudden or abrupt impulses to a selected portion of the stack or by effecting vibratory movements of the shaping member. It has been found that such vibratory or pulse-like movements of the shaping member do not suffice to effect adequate coarse approximation of the curvature of originally straight holes (or of holes whose inclination matches or approximates the lead of a spiral binder) to the curvature of a convolution, especially if the stack is rather thick. Moreover, the just discussed teaching of German Pat. No. 1,817,815 is unsatisfactory on the additional ground that it takes up too much time to convert the originally straight holes into passages whose curvature and lead match the corresponding characteristics of convolutions which form part of a spiral binder. This is due to the fact that the final or precise adjustment or shifting of leaves so as to impart to the holes a desired optimum (arcuate) shape takes place in two successive stages or steps, i.e., coarse orientation must precede the final orientation of leaves relative to each other. The adjustment is carried out at two successive stations or in two successive stages at one and the same station. In either event, the interval of time which is spent for the conversion of originally straight holes into arcuate passages whose curvature matches that of the convolutions and whose lead matches the lead of the convolutions forming part of a spiral binder is quite long so that the changes in configuration of the holes necessitates a reduction in the output of the machine wherein the stacks are treated for the purpose of being converted or assembled into pads or like stationary products. Otherwise stated, the apparatus for converting originally straight holes into arcuate holes of appropriate curvature and lead constitutes a bottleneck in the machine or production line wherein sheets of paper or the like are assembled into stacks and the stacks are assembled with binders to form note books, pads, exercise books or the like. The provision of two successive stations at the first of which the holes are subjected to coarse treatment and at the second of which the holes are oriented with the aid of aforementioned arcuate mandrels is more satisfactory insofar as the time element is concerned because a stack can be subjected to a secondary or final treatment at the second station while the next-following stack is subjected to a preliminary treatment at the preceding station; however, the provision of two discrete stations contributes to the bulk, initial and maintenance cost of the machine wherein the apparatus for converting originally straight holes in stacks of paper leaves or the like into arcuate holes or passages of appropriate lead is put to use.

OBJECTS AND SUMMARY OF THE INVENTION

An object of the invention is to provide a novel and improved apparatus for changing the curvature of holes in stacked paper leaves or the like in a time- and space-saving operation.

Another object of the invention is to provide an apparatus which can rapidly convert originally straight or sloping holes into arcuate passages irrespective of whether the stack of leaves is thin, thick or very thick.

A further object of the invention is to provide an apparatus wherein the curvature of holes in a stack of paper leaves or the like can be changed in a single operation and at a single station so that the apparatus which is used for effecting such changes in curvature of holes occupies little room and can be installed in compact machines for the making of stationery products.

An additional object of the invention is to provide an apparatus which can readily and rapidly convert originally straight or inclined holes into arcuate passages with radii of curvature which closely approximate or match the radii of curvature of convolutions forming part of helical wire binders of the type used for the making of steno pads, exercise books or the like.

Another object of the invention is to provide the apparatus with novel and improved means for shifting the leaves of successive stacks relative to each other in a small area, with little loss in time and in a fully automatic way.

A further object of the invention is to provide the apparatus with novel and improved means for changing the positions of mandrels which are used to enter the holes of stacked leaves consisting of paper or the like.

An ancillary object of the invention is to provide novel and improved means for indirectly changing the inclination of two or more mandrels with reference to each other.

A further object of the invention is to provide a novel and improved method of converting originally straight or inclined holes of stacked paper leaves or the like into arcuate passages with predetermined radii of curvature.

The invention is embodied in an apparatus for converting elongated (straight or sloping) holes which extend substantially transversely of an elongated edge face of a stack of overlapping leaves (e.g., paper sheets) into arcuate passages, each of which consists of at least partially registering perforations in the leaves of the stack and each of which has a predetermined curvature, e.g., a curvature with a radius which matches the radii of curvature of convolutions forming part of a spiral binder. The apparatus comprises means for locating a stack of leaves in a predetermined position so that at least a portion of its edge face and the ends of at least some of its holes are accessible, and first and second converting means disposed at the opposite sides of the stack in the predetermined position and each including at least one mandrel (which may but need not be straight) in register with the corresponding end of a hole at the respective side of the stack in the predetermined position, means for moving the respective mandrel into and from the registering hole of the stack in the predetermined position, and means for supporting the respective mandrel for pivotal movement about an axis which is substantially parallel to the edge face of the stack in the predetermined position. The apparatus further comprises means for pivoting the mandrels about the respective axes by way of the leaves in a stack which occupies the predetermined position. The pivoting means includes a shaping member having a convex surface and means for transporting the shaping member into engagement with the edge face of the stack in the predetermined position while the mandrels extend into the registering holes of the stack so that the edge face assumes a concave or nearly concave shape as a result of shifting of at least some leaves of the stack relative to each other whereby the thus shifted leaves pivot the mandrels about the respective axes.

Each converting means comprises or can comprise a row of mandrels, each of which registers with a different hole upon movement of the stack to the predetermined position.

The elongated holes of a stack which is moved to the aforementioned predetermined position may be straight (i.e., they may extend at right angles to the planes of the sides of the stack), or such holes may be inclined so that, upon conversion into passages, the holes have a predetermined curvature as well as a predetermined lead. The conversion of originally straight holes into holes having a predetermined inclination or lead can be effected in a number of ways, e.g., in a manner as disclosed in the aforementioned German Pat. No. 1,817,815 to which reference may be had, if necessary. As explained in the German patent, conversion of the originally straight holes which extend at right angles to the sides of a stack of overlapping paper leaves or the like into inclined or sloping holes (so that the converted holes or passages have a predetermined lead) can be effected during assembly of leaves into stacks so that such conversion of straight holes into inclined or sloping holes does not take up additional time in a machine wherein the leaves are assembled into stacks, wherein the stacks are perforated, broken up and reassembled (if the perforating operation necessitates temporary breaking up of thicker stacks into two or more thinner stacks or piles), shifted to convert straight or inclined holes into arcuate passages and connected with spiral or otherwise configurated binders, and wherein the stacks are or can be subjected to other treatment or treatments (such as bending of end portions of outermost convolutions of the spiral binder, e.g., in a manner as disclosed in U.S. Pat. No. 4,095,623 granted June 20, 1978 to Jörn-Uwe Lemburg et al.).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
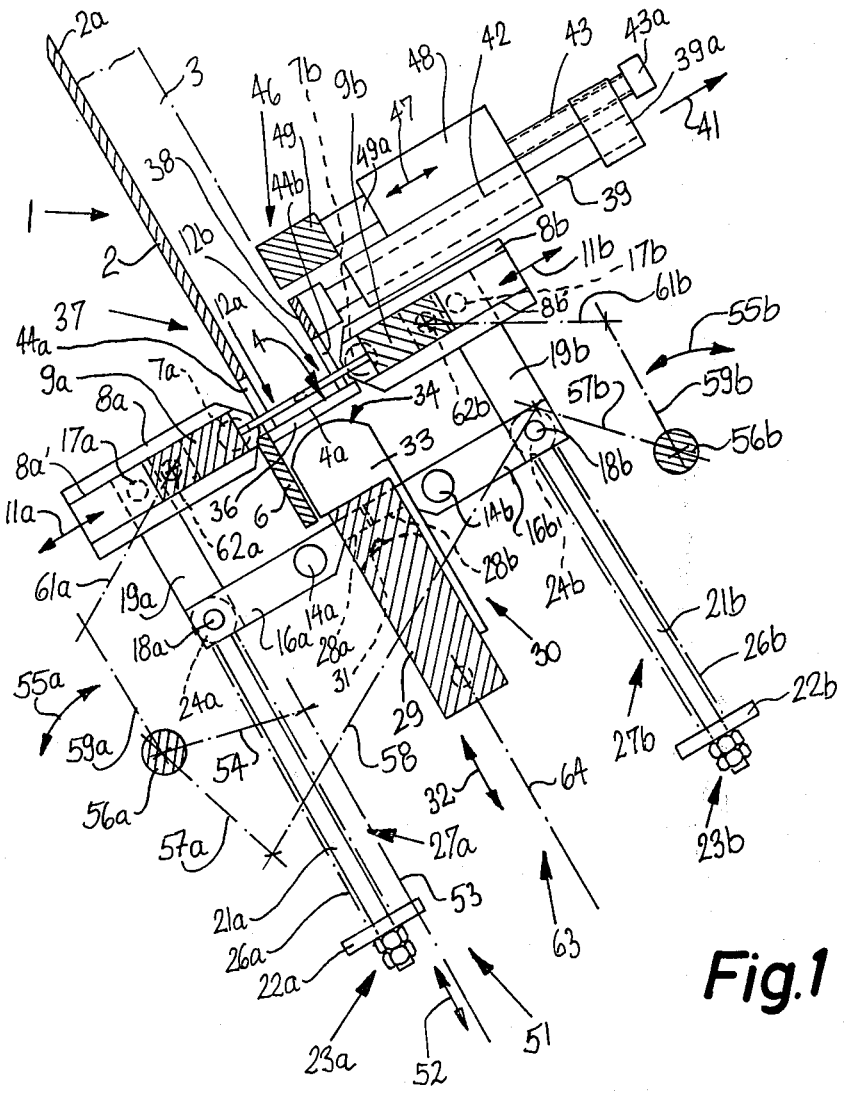
FIG. 1 is a schematic transverse vertical sectional view of an apparatus which embodies one form of the invention, a stack of overlapping leaves being shown in the predetermined position and the mandrels of the converting means extending into the registering holes of the stack.
Figure 3:
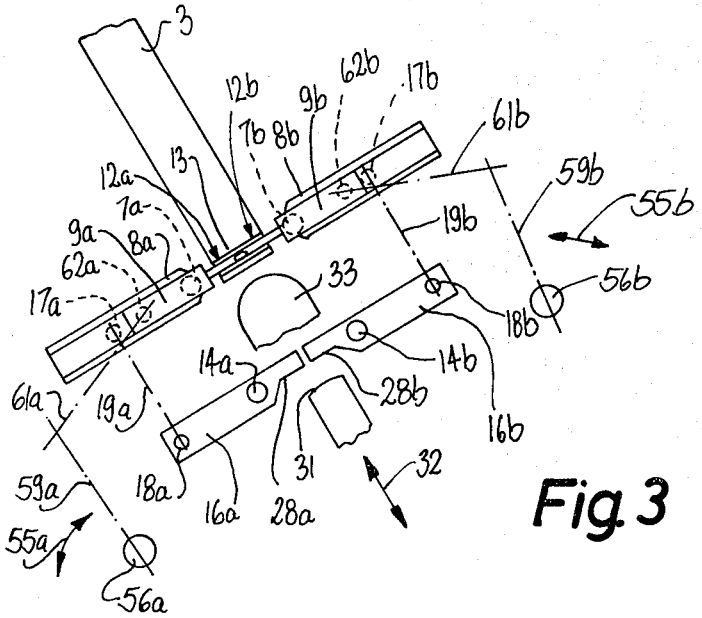
FIG. 3 illustrates the structure of FIG. 2, with the mandrels shown in positions corresponding to those depicted in FIG. 1.
Figure 4:
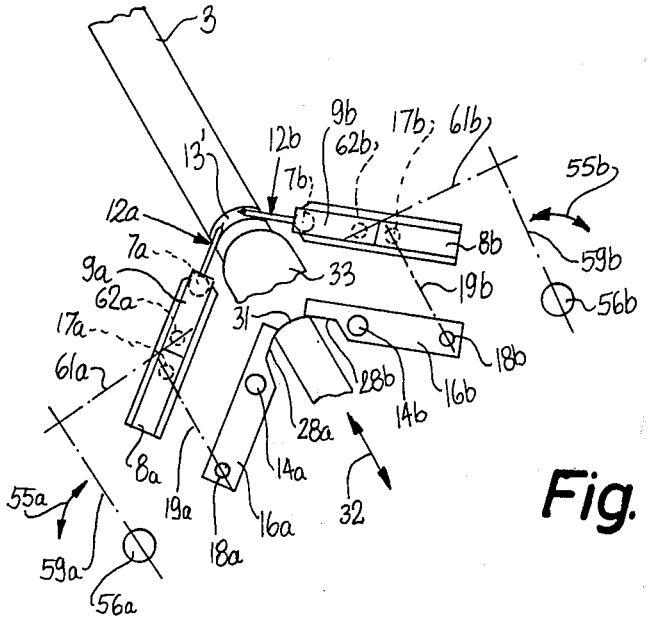
FIG. 4 illustrates the structure of FIG. 2 or 3, with the mandrels shown in extended or inserted positions subsequent to deformation of the edge face of the stack by the shaping member.
Figure 5:
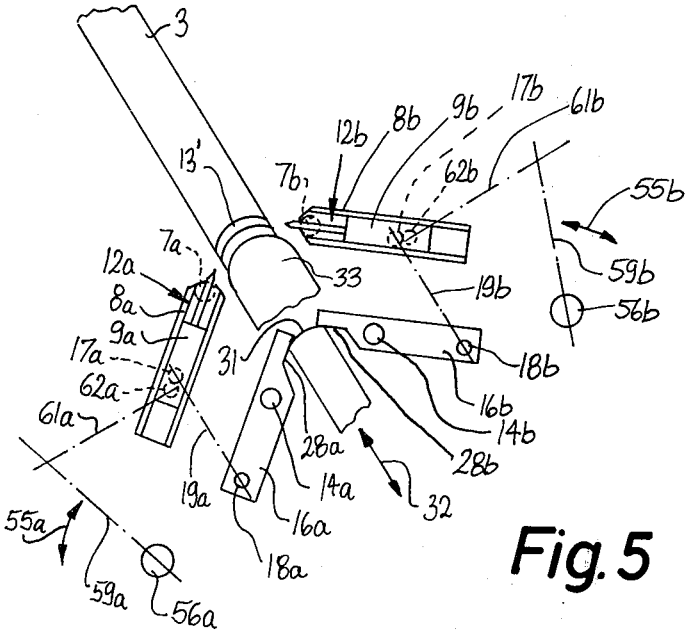
FIG. 5 illustrates the structure of FIG. 4, with the mandrels shown in retracted positions upon completion of the converting operation.

Referring first to FIG. 1, there is shown an apparatus which is utilized to convert the originally straight or inclined elongated holes 13 (FIGS. 2–3) in a stack 3 of overlapping leaves or sheets made of paper or the like into arcuate passages 13′ shown in FIGS. 4 and 5. For the sake of simplicity and clarity, the major part of the frame of the machine in which the apparatus is installed has been omitted, together with the means for advancing successive stacks of a series of stacks to the predetermined position occupied by the stack 3 shown in FIG. 1 as well as with the means for transporting stacks from the station which is shown in FIG. 1 to the next-following station, e.g., to a station where the stack 3, with passages 13′ formed therein as shown in FIGS. 4 and 5, is coupled with a spiral binder to form therewith a note book, steno pad, exercise book or a like stationery product. A machine, known as a spiral binding machine, in which the apparatus of the present invention can be used is described, for example, in the commonly owned copending application Ser. No. 156,352 filed June 4, 1980 by Paul Fabrig for "Apparatus for transporting stacks of paper sheets or the like". The machine comprises a hollow frame or support for several tongs which transport stacks of the aforementioned series from station to station. At the first station, a stack of sheets is inserted by hand or by a suitable conveyor. The stack is thereupon advanced to the next station at which it is broken up into smaller piles which are formed with perforations prior to reassembly of piles into a single stack at the next station (called gathering station). At the next-following station, the stacks can be treated in an apparatus of the type embodying the present invention, and the thus treated stacks are thereupon transported to a spiral binder inserting station. The next-following station comprises means for converting the end portions of outermost convolutions of spiral binders into hooks or analogous configurations so as to reduce the likelihood of injury and/or interlacing of neighboring spiral binders of stationery products. The products are thereupon assembled into stacks and, if necessary, wrapped in foils of transparent plastic material prior to delivery to storage or to another destination.

It will be noted that certain component parts of the apparatus which is illustrated in FIG. 1 are shown very schematically. Thus, certain motion transmitting levers, bars, rods, links and like parts are merely denoted by phantom lines.

As already explained hereinabove, the elongated holes 13 of a stack 3 which is held in the predetermined position of FIG. 1 can be straight hole which extend at right angles to the two sides 3A and 3B of the stack. Alternatively, such holes may be inclined in a plane which is parallel to the rear edge face 3R (see FIG. 2) of the stack in such position. In the latter instance, the passages 13′ shown in FIGS. 4 and 5 have a curvature matching or approximating that of the convolutions of a spiral binder which is about to be inserted into the passages 13′, and the passages 13′ have a lead corresponding to that of the just mentioned convolutions. The conversion of straight holes 13 into holes which are inclined with reference to the plane of FIG. 1 can be effected during stacking or restacking of leaves which form the stack 3. As mentioned above, suitable instrumentalities which can cause the originally straight holes to assume a predetermined inclination resulting in appropriate lead of passages 13′ are disclosed in German Pat. No. 1,817,815 to which reference may be had, if necessary.

The apparatus of FIG. 1 comprises locating means 1 which constitutes or may constitute a component of the aforementioned hollow frame and comprises a sheet metal platform 2 whose exposed surface 2*a* slopes forwardly and downwardly and cooperates with a second surface 4*a* at the upper side of a ledge or stop 4 which is disposed at the lower end of the surface 2*a*. A stack 3 which has been properly located by the means 1 abuts against the surface 2*a* with one of its sides and its elongated edge face 3R abuts against the surface 4*a* of the stop 4. The surface 4*a* is interrupted (see the openings 36 in the stop 4), and the platform 2 has an opening 44*a* so as to afford access to the left-hand ends of holes 13 in the stack 3. Such holes are located in a plane which is parallel to the plane of the edge face 3R. The mechanisms (e.g., tongs of the type disclosed in the aforesaid copending application Ser. No. 156,353 of Fabrig) which serve to deliver stacks 3 to the locating means 1 and to transport stacks from the locating means 1 to the next station are preferably located in the interior of the hollow frame, i.e., to the left of the platform 2 shown in FIG. 1. If each such mechanism includes a tongs, one jaw of the tongs extends, at times, through the opening 44*a* of the platform 2 (or through another opening in this platform) to cooperate with a normally concealed second jaw in order to advance the stack 3 to the locating means 1 or from the locating means 1 to the next station (such as the aforementioned spiral binder inserting station).

Figure 2:
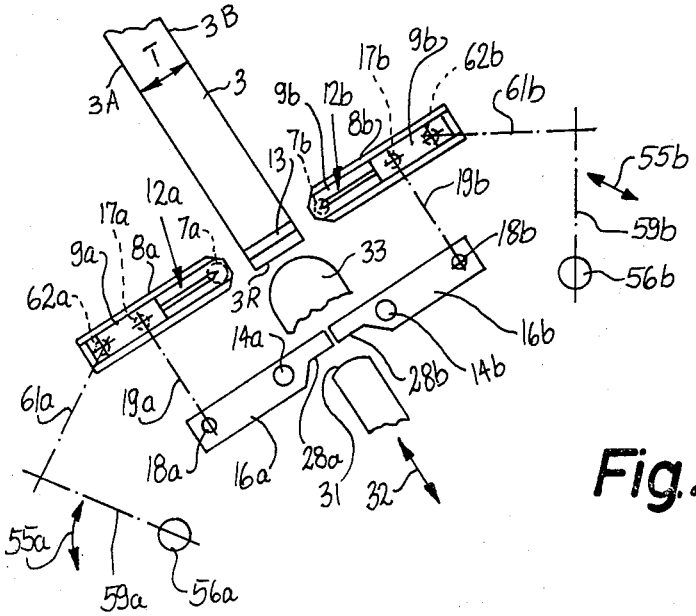
FIG. 2 illustrates a portion of the apparatus of FIG. 1, with the mandrels shown in retracted positions prior to engagement between the shaping member and the respective edge faces of the stack.

The stop 4 constitutes one leg of a substantially L-shaped bracket 6 which is installed in or forms part of the frame. r The sides 3A and 3B of the stack 3 in the locating means 1 are respectively adjacent to two elongated shafts 7*a* and 7*b* whose axes are closely adjacent to the edge face 3R (i.e., to the surface 4*a*) and are parallel to the longitudinal direction of such edge face (provided that the stack 3 is held in the predetermined position). The shafts 7*a* and 7*b* pivotably support guide members 8*a* and 8*b* which define elongated channels 8*a*′, 8*b*′ for two reciprocable carriers 9*a* and 9*b*. The directions in which the carriers 9*a* and 9*b* are reciprocable in their channels 8*a*′, 8*b*′ are respectively denoted by double-headed arrows 11*a* and 11*b*. It will be noted that the carriers 9*a* and 9*b* share the pivotal movements of guide members 8*a*, 8*b* about the axes of the respective shafts 7*a*, 7*b*, and that the carriers 9*a*, 9*b* are movable back and forth (toward and away from the respective sides 3A, 3B of the stack 3 in the locating means 1) by moving in the corresponding channels 8*a*′ and 8*b*′. The carriers 9*a* and 9*b* respectively support rows of elongated straight mandrels 12*a* and 12*b* (only one mandrel of each of these rows is actually shown in FIG. 1) whose longitudinal directions are parallel with the directions of reciprocatory movement of carriers 9*a*, 9*b* in the corresponding channels 8*a*′ and 8*b*′. The carriers 9*a* and 9*b* can move the respective mandrels 12*a* and 12*b* between the retracted positions which are shown in FIG. 2 and the extended positions which are shown in FIG. 3. In their extended positions, the mandrels 12*a* and 12*b* project into the registering holes 13 of the stack 3 in the locating means 1. The arrangement is preferably such that the holes 13 which receive portions of the mandrels 12*a* do not receive portions of the mandrels 12*b*, and vice versa. The holes 13 are preferably equidistant from each other, as considered at right angles to the plane of FIG. 1, and the combined number of mandrels 12*a* and 12*b* may match the total number of holes 13 in that marginal portion of the stack 3 which is adjacent to the edge face 3R. In such instance, each second hole 13 receives a portion of a mandrel 12*a* and the remaining holes 13 receive portions of the mandrels 12*b*. However, the number of mandrels 12*a* and/or 12*b* can be reduced to less than one-half the total number of holes 13. In fact, a single mandrel 12*a* and a single mandrel 12*b* can suffice to assist in effecting an appropriate conversion of holes 13 into arcuate passages 13'. The length of those portions of the mandrels 12*a* and 12*b* which project into the registering holes 13 (when the mandrels are held in the extended positions of FIG. 3) may be less than, equal to or more than one-half the thickness T of a stack 3 in the locating means 1.

The shafts 7*a* and 7*b* are journalled in the frame of the machine which embodies or which is combined with the improved apparatus, i.e., the positions of axes about which the guide members 8*a*, 8*b* pivot or can pivot are fixed at all times. For the sake of simplicity, the description which follows will refer to a single mandrel 12*a* and to a single mandrel 12*b*. However, it is to be understood that each of the two converting means in the improved apparatus may comprise a row of two or more aligned mandrels and that the mandrels 12*a* are preferably staggered with reference to the mandrels 12*b* so that each hole 13 can receive the tip of a single mandrel when the carriers 9*a* and 9*b* are moved to the positions which are shown in FIG. 3. If the spacing between neighboring holes 13 is constant or uniform, the spacing between neighboring mandrels 12*a* or 12*b* is a whole multiple of such uniform spacing between two neighboring holes 13.

The shafts 7*a* and 7*b* are respectively disposed above and are parallel with additional shafts 14*a* and 14*b* which are installed in the frame of the spiral binding machine and respectively support pivotable two-armed levers 16*a* and 16*b*. Those arms of the levers 16*a* and 16*b* which extend away from each other are articulately connected to lower end portions of links 19*a*, 19*b* by pivot pins 18*a*, 18*b*. The upper end portions of the links 19*a*, 19*b* are respectively connected to the guide members 8*a*, 8*b* by pivot pins 17*a*, 17*b*. The shorter arms or portions 28*a*, 28*b* of the levers 16*a*, 16*b* extend toward each other and can be pivoted by a displacing member 31 which is reciprocable in directions indicated by a double-headed arrow 32, i.e., in parallelism with the planes of leaves which form the stack 3 in the locating means 1.

The aforementioned pivot pins 18*a* and 18*b* are further connected to the upper end portions of elongated rods 21*a*, 21*b* whose lower end portions extend through holes which are machined in fixed holders 22*a*, 22*b*. Such lower end portions of the rods 21*a* and 21*b* are externally threaded to mate with nuts 23*a*, 23*b* serving as a means for limiting the extent of upward movement of the respective rods under the action of yieldable biasing means, here shown as helical springs 26*a* and 26*b*. These springs together constitute means (27*a* and 27*b*) for opposing pivoting of the mandrels 12*a* and 12*b* from the starting angular positions shown in FIGS. 1, 2 and 3 to the pivoted positions shown in FIGS. 4 and 5. The springs 26*a* and 26*b* react against the respective fixed holders 22*a*, 22*b* and bear against the longer outer arms of the levers 16*a*, 16*b* so as to tend to pivot the lever 16*a* clockwise and to pivot the lever 16*b* counterclockwise, as viewed in FIG. 1. The maximum extent of pivotal movement of levers 16*a*, 16*b* under the action of springs 26*a*, 26*b* is adjustable by appropriate adjustment of the nuts 23*a* and 23*b*. The levers 16*a* and 16*b* are respectively parallel or nearly parallel to the corresponding guide members 8*a* and 8*b*. It goes without saying that the pivot pins 17*a*, 18*a*, 17*b* and 18*b* can extend through arcuate slots, straight slots or round holes of the parts 8*a*, 8*b*, 19*a*, 19*b*, 16*a*, 16*b* and/or 21*a*, 21*b* in order to allow for articulation of the system which is shown in FIG. 1 when the shorter arms or portions 28*a*, 28*b* of the levers 16*a*, 16*b* are pivoted by the displacing member 31 or by the springs 26*a*, 26*b*. The reference characters 24*a* and 24*b* denote eyelets which are provided at the upper ends of the respective rods 21*a*, and 21*b* and through which the shanks of the corresponding pivot pins 17*a*, 17*b* extend.

In the apparatus of FIG. 1, the axial positions of nuts 23*a* and 23*b* on the corresponding rods 21*a*, 21*b* are selected in such a way that, when held in their starting angular positions, the mandrels 12*a* and 12*b* are located in a common plane coinciding with the plane of holes 13 in the stack 3 which has been properly inserted into the locating means 1.

The displacing member 31 which can pivot the levers 16*a*, 16*b* by way of the shorter arms or portions 28*a*, 28*b* is mounted on a support 29 which is reciprocable in the directions indicated by the aforementioned arrow 32. The support 29 further carries a shaping member 33 which may consist of several discrete sections disposed one behind the other, as considered at right angles to the plane of FIG. 1, and registering with the openings 36 of the ledge 4 so that the convex upper surfaces 34 of the sections of the shaping member 33 can engage and deform the edge face 3R of the stack 3 in the locating means 1.

The curvature of the convex surface 34 equals or closely approximates the desired curvature of arcuate passages 13' and the curvature of convolutions of a spiral binder which is to be introduced into the passages 13' at the appropriate station of the machine which employs the apparatus of FIG. 1.

The reference character 30 denotes a control unit which includes the levers 16*a*, 16*b* and the displacing member 31 and whose purpose is to maintain the mandrels 12*a*, 12*b* in the pivoted positions of FIG. 4 or 5 upon completion of conversion of holes 13 into arcuate passages 13'. Such retention of mandrels 12*a*, 12*b* in the pivoted positions of FIGS. 4 and 5 is temporary and can be terminated as soon as the tips of the mandrels are retracted from the respective ends of the registering arcuate passages 13'. The retracted positions of the mandrels 12*a* and 12*b* are shown in FIG. 5.

The locating means 1 for the stack 3 can further comprise a unit 37 which is located opposite the platform 2 and serves to hold the right-hand outermost leaf of the stack 3 against movement away from the exposed surface 2*a*. The unit 37 comprises a sheet metal plate 38 which is parallel to the platform 2 and is movable in and counter to the direction indicated by the arrow 41. The plate 38 is connected to the front end portion of a tie rod 39 which is reciprocable in a bearing sleeve 42. The means for moving the tie rod 39 relative to the sleeve 42 forms part of the spiral binding machine and is not specifically shown in the drawing. It suffices to say that the plate 38 is moved to the position of FIG. 1 when a stack 3 is properly located on the surfaces 2*a* and 4*a*, and that the tie rod 39 is caused to retract the plate 38 in the direction of arrow 41 in order to allow for unimpeded transport of the stack 3 to the next station as well as for introduction of the next-following stack into the locating means 1. The retracted position of the plate 38 and its tie rod 39 can be selected in dependency on the thickness of a stack 3 by appropriate adjustment of the axial position of a screw 43 which mates with a bearing member 48. When the enlarged rear end portion 39*a* of the tie rod 39 strikes against the head 43*a* of the screw 43, the plate 38 is held against further movement away from the platform 2. The sleeve 42 accommodates or supports a spring (not specifically shown) which tends to maintain the plate 38 in the operative position of FIG. 1, i.e., in that position in which the plate 38 cooperates with the platform 2 to prevent excessive spreading of the stack 3 in the locating means 1. The plate 38 has an opening 44*b* which enables the mandrel or mandrels 12*b* to enter the corresponding end or ends of the hole or holes 13 in the stack 3 resting on the surfaces 2*a* and 4*a*.

The apparatus further comprises a clamping device 46 which is reciprocable by the drive means of the spiral binding machine and serves to temporarily grip and clamp the stack 3 upon conversion of holes 13 into arcuate passages 13'. The clamping devide 46 comprises a jaw 49 which is reciprocable in directions indicated by arrow 47 and is guided by the bearing member 48. The means for moving the shank 49*a* of the jaw 49 to and from the position shown in FIG. 1 is not illustrated in the drawing; such means derives motion from the prime mover of the spiral binding machine, e.g., through the medium of a camshaft or the like. The jaw 49 can bias the leftmost leaf of the stack 3 against the surface 2*a* before the stack is transported to the next station, i.e., before the stack 3 (with the holes 13 converted into arcuate passages 13') is engaged by the aforementioned tongs which may be of the type disclosed in the aforesaid copending application Ser. No. 156,353 of Paul Fabrig.

The means 51 for moving the carriers 9*a* and 9*b* in the channels 8*a'*, 8*b'* of the respective guide members 8*a*, 8*b* (i.e., for moving the mandrels 12*a* and 12*b* between their extended and retracted positions) comprises a motion transmitting rod 53 (indicated by a phantom line) which derives motion (see the arrow 52) from the aforementioned camshaft of the spiral binding machine and is articulately connected to a link 54 which latter is pivotable about the axis of a shaft 56*a*. The shaft 56*a* can pivot a link 59*a* which is articulately connected with a further link 61*a*. The link 61*a* is coupled to the carrier 9*a* by a pin 62*a*. The shaft 56*a* further transmits motion to a link 57*a* which is articulately connected to a link 58 cooperating with a link 57*b* serving to turn a shaft 56*b*. The latter is connected with the carrier 9*b* by way of a pin 82*b* and two links 61*b*, 59*b*. The directions in which the shaft 56*b* can be turned by the link 57*a* via links 58 and 57*b* are indicated by a double-headed arrow 55*b*. The arrow 55*a* denotes the directions of angular movement of the shaft 56*a* in response to movements of the motion transmitting member 53 in directions indicated by the arrow 52. It will be readily appreciated that the just described means 51 for moving the carriers 9*a*, 9*b* is designed to move the two carriers and hence the mandrels 12*a*, 12*b* through identical distances but in opposite directions, i.e., the mandrel 12*a* will move in a direction to the right, as viewed in FIG. 1, when the mandrel 12*b* is caused to move in a direction to the left, and vice versa.

The means 63 for transporting the support 29 for the shaping member 33 and displacing member 31 in directions indicated by the double-headed arrow 32 comprises a motion transmitting rod 64 (indicated by phantom lines) which receives motion from the prime mover of the spiral binding machine in synchronism with movements of the rod 53 and jaw 49. The aforementioned camshaft of the spiral binding machine can reciprocate the rod 64 through the medium of a suitable disc cam or the like.

The operation is as follows.

A stack 3 is positioned in the locating means 1 so that it assumes the predetermined position which is shown in FIG. 1, i.e., the elongated edge face 3R of such stack abuts against the surface 4*a* of the stop or ledge 4, and the side 3A of the stack abuts against the exposed surface 4*a* of the platform 4. The position of the stack 3 in FIG. 1 corresponds to that which is shown in FIG. 2. In FIG. 2, the clamping device 46 (not specifically shown) is inactive, i.e., the jaw 49 is remote from the side 3B of the stack 3. The plate 38 of the unit 37 abuts against the lower portion of the right-hand side 3B of the stack 3. The adjustment (axial position) of the screw 43 is selected in such a way that the plate 38 cannot exert a pronounced pressure against the rightmost leaf of the stack 3. All the plate 38 has to do is to guide the stack 3 and to prevent undesirable spreading of the leaves during conversion of straight or inclined holes 13 into arcuate passages 13'.

The prime mover of the spiral binding machine thereupon moves the motion transmitting rod 53 downwardly, as viewed in FIG. 1, so that the shafts 56*a*, 56*b* respectively turn clockwise and counterclockwise. Consequently, the carriers 9*a* and 9*b* are caused to move toward each other and introduce the tips of the mandrels 12*a*, 12*b* into the respective ends of registering elongated holes 13 in the stack 3 (see FIG. 3). In other words, the rod 53 causes the carriers 9*a*, 9*b* to move the mandrels 12*a*, 12*b* from the retracted positions of FIG. 2 to the extended positions of FIG. 3. The means for moving the mandrel 12*a* from the retracted to the extended position comprises the rod 53, the link 54, the shaft 56*a*, the links 59*a*, 61*a*, the pin 62*a* and the carrier 9*a*. The means for moving the mandrel 12*b* from the retracted to the extended position comprises the rod 53, the link 54, the shaft 56*a*, the links 57*a*, 58 and 57*b*, the shaft 56*b*, the links 59*b*, 61*b* and the pin 62*b*. FIG. 3 shows that the mandrels 12*a*, 12*b* can extend into the respective holes 13 to an extent which exceeds one-half the thickness T of the stack 3. However, this is not absolutely necessary; it often suffices to select the strokes of the mandrels 12*a*, 12*b* between the retracted and extended positions in such a way that the length of that portion of a mandrel which penetrates into the respective elongated hole 13 equals or is even less than one-half the thickness T of a stack 3.

In the next step, the prime mover of the spiral binding machine moves the motion transmitting rod 64 upwardly, as viewed in FIG. 1, whereby the rod 64 moves the support 29 in the same direction and the support 29 lifts the displacing member 31 and the shaping member 33. The convex surfaces 34 of aligned sections of the shaping member 33 move against and deform the edge face 3R of the stack 3. This results in shifting of at least some leaves of the stack 3 relative to each other. The shifting begins in the central portion of the stack 3, i.e., at the apices of the convex surfaces 34. Otherwise stated, the surfaces 34 begin to lift some or all of the leaves off the surface 4*a* of the stop 4. Such shifting of some or all of the leaves in the stack 3 entails pivoting of the mandrels 12*a*, 12*b* from the starting angular positions which are shown in FIGS. 2 and 3 to the pivoted positions which are shown in FIGS. 4 and 5, i.e., the mandrels 12*a*, 12*b* are pivoted by the shaping member 33 through the medium of component parts of the stack 3 in the locating means 1. The angular movements of mandrels 12*a*, 12*b* under the action of rising leaves of the stack 3 are shared by the guide members 8*a*, 8*b* and carriers 9*a*, 9*b*, i.e., such parts pivot with the respective mandrels about the axes of the corresponding shafts 7*a* and 7*b*.

In many instances, the extent of upward movement of the shaping member 33 is selected in such a way that each and every leaf of the stack 3 is shifted away from the surface 4*a* when the member 33 completes its movement from the inoperative position of FIG. 1, 2 or 3 to the operative position of FIG. 4 or 5. This ensures that the mandrels 12*a*, 12*b* (which are biased against movement from the starting angular positions of FIGS. 2 and 3 by the respective springs 26*a*, 26*b*) urge each and every leaf of the stack 3 against the convex surfaces 34 of sections of the shaping member 33. Consequently, the curvature of arcuate passages 13' matches or very closely approximates an optimum curvature, namely, the radii of curvature of the passages 13' match or closely approximate the radii of curvature of convolutions of a spiral wire binder which is about to be introduced into the passages 13' to hold the leaves of the stack 3 against uncontrolled movement relative to each other.

Since the shafts 7*a* and 7*b* are rather closely adjacent to the respective sides 3A, 3B of the stack 3 and are parallel with the longitudinal direction of the edge face 3R, shifting of leaves by the ascending shaping member 33 entails partial retraction of mandrels 12*a*, 12*b* from the respective arcuate passages 13' (see FIG. 4). Such partial retraction of mandrels 12*a*, 12*b* from the respective passages 13' takes place in spite of the fact that the motion transmitting rod 53 is idle, i.e., that the means for moving the mandrels 12*a*, 12*b* to the retracted positions is inactive while the shaping member 33 moves upwardly under the action of the motion transmitting rod 64.

When the rod 64 completes its upward stroke, i.e., when the shaping member 33 assumes its operative position, the displacing member 31 bears against the shorter arms or portions 28*a*, 28*b* of the levers 16*a*, 16*b* and maintains these levers in the angular positions which are shown in FIG. 5. This enables the levers 16*a*, 16*b* to maintain the mandrels 12*a*, 12*b* in the pivoted positions of FIG. 5 so that the mandrels can be readily retracted from the respective arcuate passages 13' by the simple expedient of shifting the rod 53 in a direction to move the carriers 9*a*, 9*b* away from each other (while the displacing member 31 continues to dwell in the position of FIG. 5). The levers 16*a*, 16*b* stress the respective springs 26*a*, 26*b* while the rod 53 causes the carriers 9*a*, 9*b* to move from the positions of FIG. 4 to those which are shown in FIG. 5, i.e., during retraction of the mandrels 12*a* and 12*b* from the respective arcuate passages 13'.

Retraction of the mandrels 12*a*, 12*b* to the positions of FIG. 5 is preceded by movement of the jaw 49 against the right-hand side 3B of the stack 3 so that the configuration of the passages 13' remains unchanged after the mandrels 12*a*, 12*b* are withdrawn therefrom. The rod 64 is thereupon causes to move downwardly and to retract the shaping member 33 to the inoperative position. The configuration of arcuate passages 13' remains unchanged because the leaves of the stack 3 are biased against the platform 2 by the jaw 49 which is held in the operative position. The springs 26*a* and 26*b* are free to dissipate energy as soon as the rod 64 moves the displacing member 31 downwardly whereby the levers 16*a*, 16*b* are caused to pivot back to the positions shown in FIGS. 1 to 3 so that the apparatus is ready to treat the next stack. The stack 3 whose holes 13 have been converted into arcuate passages 13' is then grasped by the aforementioned tongs and is transported to the next station wherein the leader of the spiral wire binder is threaded through successive arcuate passages 13' to convert the binder and the stack into a note book, steno pad, calender or a similar stationery product.

An advantage of straight mandrels 12*a* and 12*b* is that the conversion of straight or inclined holes 13 into arcuate passages 13' of desired curvature can be completed at a single station and in a single operation. Thus, the straight mandrels can be readily introduced into the respective end portions of straight elongated holes 13, and they are thereupon pivoted by the shaping member 33 through the medium of some or all of the leaves in a stack 3 which is properly positioned in the locating means 1 so that the conversion of holes 13 into arcuate passages 13' is completed as soon as the shaping member 33 reaches its operative position. The mandrels 12*a* and 12*b* compel the leaves of the stack 3 to abut against the surfaces 34 of sections of the shaping member 33 while the latter advances to its operative position which, in turn, ensures that each and every passage 13' assumes an optimum configuration (curvature). As mentioned above, shifting of the leaves begins in the central zone and progresses toward the outermost leaves of the stack 3. Relative movement of all leaves with respect to each other and with respect to the platform 2 and plate 38 is normally desirable because this ensures that each and every leaf assumes an optimum position in which the positions of perforations in neighboring leaves are such that, in their entirety, these perforations form arcuate passages 13' having a desirable optimum curvature for convenient insertion of a spiral wire binder or of the normally C-shaped prongs of a so-called twin wire binder.

Another important advantage of the improved apparatus is that it comprises a relatively small number of simple and inexpensive parts. This is also attributable to the provision of straight mandrels and to the feature that a single stroke of the shaping member 33 suffices to move all or nearly all leaves of a stack in the locating means 1 to their optimum positions.

The tips of the mandrels 12*a* and 12*b* are not likely to collide with the surfaces surrounding the respective holes 13 and passages 13' if the mandrels are reciprocable to such an extent that the length of those portions of mandrels which project into the holes 13 while the mandrels assume their extended positions approximates one-half the thickness T of a stack 3. The extent of movement of the shaping member 33 to its operative position is or can be such that each and every leaf of the stack 3 in the locating means 1 moves relative to the axes of the shafts 7a and 7b before the upward movement of the member 33 is completed. The placing of shafts 7a, 7b close to the respective sides 3A, 3B of the stack 3 in the locating means 1 is desirable and advantageous because (and is already explained in connection with FIGS. 4 and 5) the mandrels 12a and 12b are partially withdrawn from the respective arcuate passages 13' during the last stage of movement of the shaping member 33 to its operative position. This, in turn, renders it possible to select the extended and retracted positions of the mandrels 12a, 12b in such a way that the inserted portion of each mandrel has a length which at least slightly exceeds one-half the thickness T of the stack 3. In other words, and if one looks at FIG. 3, the tips of the mandrels 12a, 12b shown therein would overlap each other if such mandrels were introduced into one and the same hole 13 of the stack 3.

The provision of springs 26a and 26b is desirable because such means for opposing the movement of mandrels 12a, 12b from their starting angular positions ensures that the mandrels urge all leaves of the stack 3 against the surfaces 34 when the shaping member 33 reaches its operative position. It is clear that the springs 26a, 26b constitute but one form of means for yieldably biasing the mandrels 12a and 12b to their starting angular positions. One could employ torsion springs acting between the shafts 7a, 7b and the respective guide members 8a, 8b to permanently but yieldably urge the guide members and the corresponding carriers 9a, 9b to the angular positions shown in FIGS. 1, 2 and 3.

The mounting of mandrels 12a, 12b in or on carriers 9a, 9b which are reciprocable in the channels 8a', 8b' of guide members 8a, 8b which, in turn, are pivotable about the axes of the shafts 7a and 7b, is desirable and advantageous because such assembly can be readily modified to enable the mandrels to penetrate into the holes of relatively thick or relatively thin stacks.

The purpose of the displacing member 31 and of temporary retention of the rod 64 in its upper end position subsequent to conversion of holes 13 into arcuate passages 13' is to ensure that the tips of the mandrels 12a and 12b cannot damage or deface the surfaces surrounding the arcuate passages 13' during retraction of the mandrels from such passages. In other words, the displacing member 31 cooperates with the portions 28a, 28b of the levers 16a, 16b to ensure that the mandrels 12a, 12b remain in the pivoted positions of FIGS. 4 and 5 when the rod 53 is actuated to move in a direction to cause retraction of the mandrels 12a, 12b from the arcuate passages 13' through the medium of the respective carriers 9a and 9b. The displacing member 31 can be mounted on the support 29 in such a way that it engages and begins to pivot the levers 16a, 16b only during the last stage of movement of the shaping member 33 to its operative position.

The aforedescribed configuration and orientation of component parts of the locating means 1 also exhibits a number of advantages, especially as concerns the accessibility of component parts of the apparatus. Thus, by using a platform 2 whose exposed surface 2a slopes downwardly and forwardly and whose lower end is adjacent to the upper surface 4a of the stop 4, the stack 3 in the locating means 1 is readily accessible and can be observed during conversion of its holes 13 into arcuate passages 13'. The plane of the surface 4a is preferably normal to the plane of the surface 2a. The inclination of the surface 2a is preferably sufficient to ensure that the leaves of a stack 3, which is not biased against the platform 2 with an excessive force, can readily descend to move their lower edges against the surface 4a of the stop 4. The just described inclination of the surface 2a is also desirable in connection with the transport of stacks 3 from station to station, i.e., toward as well as away from the station which is shown in FIG. 1. This will be readily appreciated upon perusal of the aforementioned copending application Ser. No. 156,353 of Fabrig.

The placing of the shaping member 33 and of the various moving and transporting means behind the platform 2 (i.e., into the interior of the aforementioned hollow frame or housing of the spiral binding machine) also entails numerous advantages. Thus, such parts are not readily contaminated, they are shielded from damage, and they cannot injure the attendants.

Without further analysis, the foregoing will so fully reveal the gist of the present invention that others can, by applying current knowledge, readily adapt it for various applications without omitting features that, from the standpoint of prior art, fairly constitute essential characterisics of the generic and specific aspects of my contribution to the art and, therefore, such adaptations should and are intended to be comprehended within the meaning and range of equivalence of the appended claims.

I claim:

1. Apparatus for converting elongated open-ended hole which extend transversely of an elongated edge face of a stack of overlapping leaves into arcuate passages each consisting of at least partly registering perforations in the leaves of the stack, comprising means for locating the stack in a predetermined position so that at least a portion of its edge face and the ends of at least some of its holes are accessible; first and second converting means disposed at the opposite sides of the stack in said position and each including at least one mandrel in register with the corresponding end of the hole at the respective side of the stack in said position, means for moving the respective mandrel into and from the registering hole, and means for supporting the respective mandrel for pivotal movement about an axis which is substantially parallel to the edge face of the stack in said position; and means for pivoting said mandrels about the respective axes through the medium of the leaves of the stack in said position, including a shaping member having a convex surface, and means for transporting said surface of said shaping member into engagement with the edge face of the stack in said position while said mandrels extend into the registering holes so that said edge face assumes a concave shape which is complementary to said convex surface as a result of shifting of at least some leaves of the stack in said position whereby the thus shifted leaves pivot said mandrels about the respective axes.

2. The apparatus of claim 1, wherein said mandrels are substantially straight.

3. The apparatus of claim 1, wherein each of said converting means comprises a row of mandrels each of which registers with a different hole upon movement of the stack to said position.

4. The apparatus of claim 1 for converting the elongated holes of a stack having a predetermined thickness, wherein said moving means is operative to move the respective mandrels between extended positions in which each of said mandrels projects into the registering hole to an extent approximately one-half of said predetermined thickness and retracted positions in which the mandrels are fully withdrawn from the registering holes upon conversion of such holes into arcuate passages.

5. The apparatus of claim 1, wherein said transporting means is operative to reciprocate said shaping member between an inoperative position in which said convex surface is out of contact with the edge face of the stack in said predetermined position and an operative position which said convex surface assumes after shifting of all leaves of the stack in said predetermined position.

6. The apparatus of claim 1, wherein said axes are closely adjacent to the respective sides of the stack in said predetermined position.

7. The apparatus of claim 6 for converting the elongated holes of a stack having a predetermined thickness, wherein said moving means is operative to move the respective mandrels between extended positions in which each of said mandrels projects into the registering hole to an extent exceeding one-half said predetermined thickness and retracted positions in which said mandrels are completely withdrawn from the respective passages.

8. The apparatus of claim 1, further comprising means for yieldably opposing pivotal movements of said mandrels about the respective axes in response to shifting of leaves of the stack in said predetermined position.

9. The apparatus of claim 1, further comprising means for biasing said mandrels to predetermined starting angular positions in which said mandrels are substantially normal to the respective sides of the stack in said predetermined position.

10. The apparatus of claim 1, wherein each of said moving means comprises a carrier pivotable with the corresponding mandrel about the respective axis, elongated guide means pivotable with and defining for said carrier an elongated path which is substantially normal to the respective axis, and means for reciprocating said carrier along the corresponding path.

11. The apparatus of claim 10, wherein said mandrels are elongated and substantially parallel with the respective paths.

12. The apparatus of claim 10, further comprising means for yieldably biasing said mandrels to predetermined starting angular positions in which said mandrels register with the corresponding holes of a stack in said predetermined position.

13. The apparatus of claim 1, further comprising means for retaining the mandrels of said converting means in pivoted positions upon completion of transport of said shaping member into engagement with the edge face of the stack in said position.

14. The apparatus of claim 13, wherein said mandrels are pivotable between starting positions which said mandrels assume prior to transport of said shaping member into engagement with the edge face of the stack in said position and said pivoted positions in which the mandrels of one of said converting means make an oblique angle with the mandrels of the other of said converting means.

15. The apparatus of claim 1, wherein said locating means includes a downwardly sloping first surface for one side of the stack in said position and a second surface for a given edge face of the stack in said position.

16. The apparatus of claim 15, wherein said given edge face is said elongated edge face and said second surface is adjacent to a portion of said elongated edge face while said convex surface is out of contact with said elongated edge face.

17. The apparatus of claim 15, wherein said second surface is substantially normal to and is disposed at a level below said first surface.

18. The apparatus of claim 1, wherein said locating means includes means for supporting the stack in said position in the region of said mandrels.

19. The apparatus of claim 1, wherein said pivoting means is located at a level below said locating means.

20. The apparatus of claim 1, further comprising means for temporarily clamping the stack against relative movement of its leaves subsequent to pivoting of said mandrels by said shaping member through the medium of the leaves of the stack in said position.

21. The apparatus of claim 1, wherein each of said moving means comprises a carrier pivotable with the corresponding mandrel about the respective axis, elongated guide means pivotable with and defining for said carrier an elongated path which is substantially normal to the respective axis, and means for reciprocating said carrier along said path, and further comprising means for pivoting said guide means in response to transport of said shaping member including first and second shafts having axes which are respectively parallel with the pivot axes of said first and second mandrels, first and second levers pivotable about the axes of said first and second shafts, means for coupling said levers to the respective guide means, and means for pivoting said levers in response to transport of said shaping member toward engagement of its surface with the edge face of the stack in said position.

22. The apparatus of claim 21, wherein each of said coupling means comprises a link.

23. The apparatus of claim 22, wherein each of said levers including a first portion articulately connected with the respective link and a second portion constituting a follower, said means for pivoting said levers including displacing means for changing the angular positions of said levers by way of said second portions in response to movement of said shaping member toward engagement with the stack in said position.

24. The apparatus of claim 23, wherein said displacing means for changing the angular positions of said levers includes a device which shares the movements of said shaping member and engages said second portions of said levers while said shaping member is transported toward the edge face of the stack in said position.

25. Apparatus for converting elongated open-ended holes which extend transversely of an elongated face of a stack of overlapping leaves into arcuate passages each consisting of at least partly registering perforations in the leaves of the stacks, comprising means for locating the stack in a predetermined position so that at least a portion of its edge face and the ends of at least some of its holes are accessible; first and second converting means disposed at the opposite sides of the stack in said position and each including at least one mandrel in register with the corresponding end of the hole at the respective side of the stack in said position, means for moving the respective mandrel into and from the registering hole, and means for supporting the respective mandrel for pivotal movement about an axis which is substantially parallel to the edge face of the stack in said position; and means for pivoting said mandrels about the respective axes through the medium of the leaves of the stack in said position, said means for pivoting including a shaping member having a convex surface and means for transporting said surface of said shaping member into engagement with the edge face of the stack in said position while said mandrels extend into the registering holes so that said edge face assumes a concave shape which is complimentary to said convex surface as a result of shifting at least some leaves of the stack in said position whereby the thus shifted leaves pivot said mandrels about the respective axes, whereas each of said moving means comprises a carrier pivotable with the corresponding mandrel about the respective axis, elongated guide means pivotable with and defining for said carrier an elongated path which is substantially normal to the respective axis, and means for reciprocating said carrier along said path, and further comprising means for pivoting said guide means in response to transport of said shaping member including first and second shafts having axes which are respectively parallel with the pivot axes of said first and second mandrels, first and second levers pivotable about the axes of said first and second shafts, means for coupling said levers to the respective guide means, and means for pivoting said levers in response to transport of said shaping member toward engagement of its surfaces with the edge face of the stack in said position.

26. The apparatus of claim 25, wherein each of said coupling means comprises a link.

27. The apparatus of claim 26, wherein each of said levers includes a first portion articulately connected with the respective link and a second portion constituting a follower, said means for pivoting said levers including displacing means for changing the angular positions of said levers by way of said second portions in response to movement of said shaping member toward engagement with the stack in said position.

28. The apparatus of claim 27, wherein said displacing means for changing the angular positions of said levers includes a device which shares the movements of said shaping member and engages said second portions of said levers while said shaping member is transported toward the edge face of the stack in said position.

* * * * *